US009576471B2

(12) United States Patent
Penisoara et al.

(10) Patent No.: US 9,576,471 B2
(45) Date of Patent: Feb. 21, 2017

(54) RADIO FREQUENCY REMOTE CONTROLLER DEVICE, INTEGRATED CIRCUIT AND METHOD FOR SELECTING AT LEAST ONE DEVICE TO BE CONTROLLED

(75) Inventors: Nicusor Penisoara, Bucharest (RO); Razvan-Mihai Lucaci, Suceava (RO)

(73) Assignee: NXP USA, INC., Austin, TX (US)

( * ) Notice: Subject to any disclaimer, the term of this patent is extended or adjusted under 35 U.S.C. 154(b) by 1042 days.

(21) Appl. No.: 13/255,520

(22) PCT Filed: Mar. 31, 2009

(86) PCT No.: PCT/IB2009/051351

§ 371 (c)(1),
(2), (4) Date: Sep. 9, 2011

(87) PCT Pub. No.: WO2010/112973

PCT Pub. Date: Oct. 7, 2010

(65) Prior Publication Data

US 2012/0013449 A1 Jan. 19, 2012

(51) Int. Cl.
*G08C 17/02* (2006.01)

(52) U.S. Cl.
CPC ..... *G08C 17/02* (2013.01); *G08C 2201/71* (2013.01)

(58) Field of Classification Search
CPC . G08C 17/02; G08C 2201/71; G08C 2201/20; G08C 2201/21; G08C 2201/30; G08C 2201/92
USPC ..... 340/12.5, 12.22–12.23, 10.1–10.32; 398/106–108
See application file for complete search history.

(56) References Cited

U.S. PATENT DOCUMENTS

| | | | | |
|---|---|---|---|---|
| 3,757,345 | A * | 9/1973 | Carver | 343/786 |
| 5,949,351 | A * | 9/1999 | Hahm | 340/4.42 |
| 6,655,817 | B2 * | 12/2003 | Devlin et al. | 362/233 |
| 6,753,789 | B1 * | 6/2004 | Batra | G08C 17/00 340/12.5 |

(Continued)

FOREIGN PATENT DOCUMENTS

| | | | |
|---|---|---|---|
| EP | 0917125 | A1 | 5/1999 |
| WO | 2006090071 | A1 | 8/2006 |
| WO | WO 2006090071 | A1 * | 8/2006 |

OTHER PUBLICATIONS

EP Application No. EP09842554; Supplementary Search Report, Aug. 6, 2012.

(Continued)

*Primary Examiner* — Firmin Backer
*Assistant Examiner* — Nay Tun

(57) ABSTRACT

A radio frequency (RF) remote controller device comprises radio frequency (RF) circuitry operably coupled to an antenna arrangement and arranged to transmit and receive RF signals to and from controllable devices. The RF remote controller device further comprises signal process logic operably coupled to the RF circuitry and to a user interface. The antenna arrangement is arranged to comprise a directivity characteristic. The signal processing logic upon receipt of a command input from the user interface, is arranged to: determine at least one link quality value that is at least partly dependent upon the directivity characteristic for the at least one controllable device; and select the controllable device for remote controlling based on the determined at least one link quality value.

18 Claims, 3 Drawing Sheets

(56) References Cited

U.S. PATENT DOCUMENTS

| | | | | |
|---|---|---|---|---|
| 6,754,467 | B1 | 6/2004 | Ide et al. | |
| 2002/0027569 | A1* | 3/2002 | Manni et al. | 345/764 |
| 2004/0121725 | A1* | 6/2004 | Matsui | 455/3.06 |
| 2004/0140882 | A1* | 7/2004 | Burleson et al. | 340/3.71 |
| 2005/0162569 | A1 | 7/2005 | Fairhurst et al. | |
| 2005/0200499 | A1* | 9/2005 | Di Peppe | 340/870.28 |
| 2006/0012489 | A1 | 1/2006 | Yokota et al. | |
| 2006/0170610 | A1 | 8/2006 | Rabinovich et al. | |
| 2006/0197676 | A1 | 9/2006 | Smith | |
| 2007/0043453 | A1* | 2/2007 | Buil | 700/65 |
| 2009/0052899 | A1* | 2/2009 | Mok et al. | 398/106 |
| 2010/0039282 | A1* | 2/2010 | Hostage et al. | 340/825.22 |
| 2012/0001844 | A1* | 1/2012 | Auguste | G06F 1/1632 345/156 |

OTHER PUBLICATIONS

Fuhrmann Thomas et al: "Bluewand—A Versatile Remote Control and Pointing Device" Institut für Telematik Universität Karlsruhe, Germany, pp. 1-8.

Ouchi Kazushige et al: "Magicwand: An Intuitive Gesture Remote Control for Home Appliances" IEEE, 2005, Web page: http://ieeexplore.ieee.org/stamp/stamp.jsp?arnumber=01505336, p. 274.

International Search Report and Written Opinion correlated to PCT/IB2009/051351 dated May 30, 2011.

* cited by examiner

RADIO FREQUENCY REMOTE CONTROLLER DEVICE, INTEGRATED CIRCUIT AND METHOD FOR SELECTING AT LEAST ONE DEVICE TO BE CONTROLLED

FIELD OF THE INVENTION

The field of this invention relates to a method and apparatus for selecting at least one device to be controlled, and in particular to a method for selecting at least one device to be controlled by a radio frequency controller device, and a radio frequency controller device, integrated circuit and system therefor.

BACKGROUND OF THE INVENTION

In the field of Radio Frequency (RF) remote controllers, it is known for such RF remote controllers to be paired with a plurality of devices to be controlled of the same type. For example, an RF remote controller may be paired with two or more television sets, the television sets being located in different rooms within, say, a residential building. Examples of other devices to which the RF remote controller may additionally/alternatively be paired with include, by way of example, DVD (Digital Versatile Disk) players, lighting systems, air conditioning systems, etc. Such RF remote controllers may be arranged to operate using IEEE 802.15.4 global standard RF protocols (see http://www.ieee802.org/15/) such as the new RF4CE (RF for Consumer Electronics) protocol currently being developed by the RF4CE consortium (www.rf4ce.org), the applicant's SynkroRF™ entertainment control network protocol (www.freescale.com/synkro), etc.

Typically, at any given moment only one device of any given type may be selected and controlled by an input means of a user interface of the RF remote controller, such as appropriate buttons or keys. In order to select a different device of a certain type to that currently selected, a user of the RF remote controller manually selects the device that they wish to control via the user interface.

This need for a user to manually select the required device to be controlled can significantly degrade the user experience. For example, in a case where a user moves from one room to another, it may be necessary for that user to change the selection of multiple types of devices (e.g. DVD player, television set, lighting system, etc.), resulting in a cumbersome experience for the user. The need to manually select the required device to be controlled may be even more detrimental to the user experience when a plurality of devices of the same type are present within close proximity, for example within the same room, and which a user may wish to control substantially concurrently. For example, the RF remote controller device may be paired with, say, two or more lighting systems within a room. In order for the user to configure the overall lighting arrangement within the room, for example to turn two of the lighting systems 'on', whilst turning a third lighting system 'off', the user is required to manually select each lighting system in turn in order to remotely control them.

SUMMARY OF THE INVENTION

The present invention provides a method for selecting at least one device to be controlled, and a radio frequency controller device, integrated circuit and system therefor as described in the accompanying claims.

Specific examples of the invention are set forth in the dependent claims.

These and other aspects of the invention will be apparent from and elucidated with reference to the examples described hereinafter.

BRIEF DESCRIPTION OF THE DRAWINGS

Further details, aspects and examples of the invention will be described, by way of example only, with reference to the drawings. Elements in the figures are illustrated for simplicity and clarity and have not necessarily been drawn to scale.

DETAILED DESCRIPTION

Figure 1:
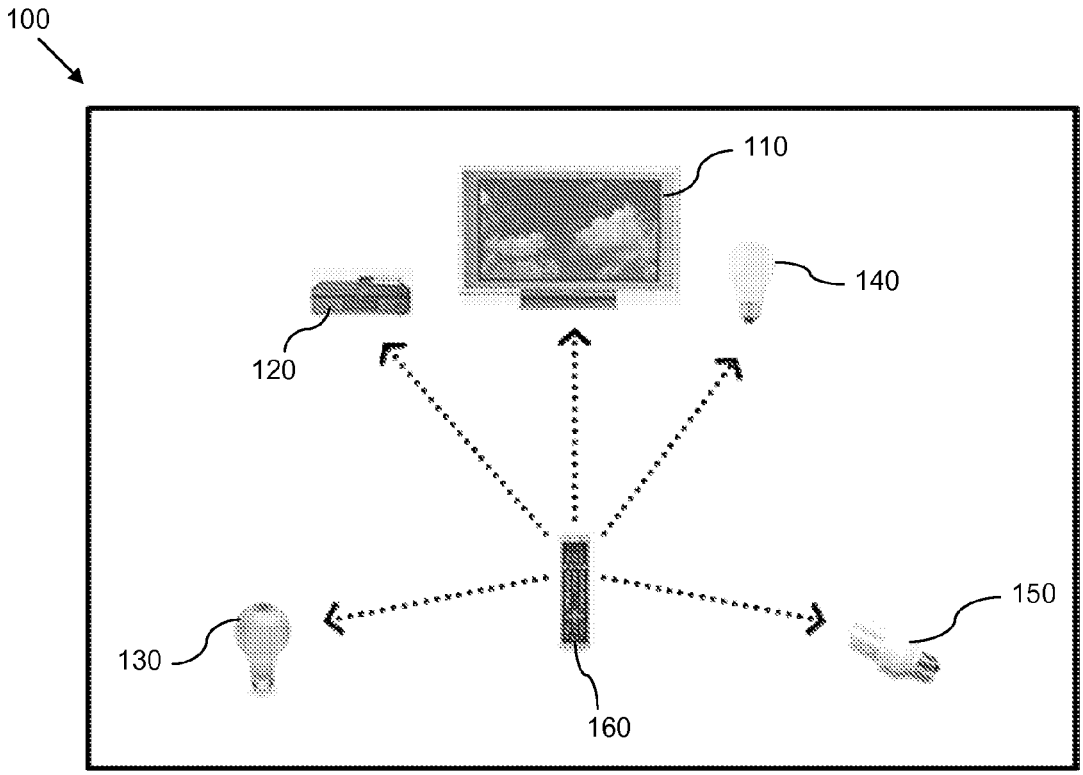
FIG. 1 illustrates an example of a radio frequency control system.

Referring now to FIG. 1, there is illustrated an example of a radio frequency (RF) control system 100. For clarity, RF may comprise frequencies ranging from, say, very high frequencies (VHF) around 30 MHz to extremely high frequencies (EHF) such as microwave frequencies around 300 GHz. The RF control system 100 comprises a plurality of controllable devices 110 to 150 and an RF remote controller device 160. For the illustrated example, the controllable devices comprise a television set 110, and a DVD (Digital Versatile Disk) player, and three lighting systems 130, 140, 150. The RF remote controller device 160 may comprise a universal/master remote control or the like. The RF remote controller device 160 is paired with, or otherwise associated with, each or a plurality of the controllable devices. The RF control system 100 may comprise, and the RF remote controller device 160 may be paired with, other types of controllable devices, such as, by way of example only, music systems, air conditioning and/or heating systems, and other home appliances and/or home entertainment devices, etc. The RF control system 100 may be arranged to operate using any suitable RF protocol, for example an IEEE 802.15.4 global standard RF protocol such as the new RF4CE (RF for Consumer Electronics) protocol currently being developed by the RF4CE consortium (www.rf4ce.org), or the applicant's SynkroRF™ entertainment control network protocol (www.freescale.com/synkro). Alternatively, such an RF control system may be based on other wireless protocols such as Bluetooth™ (see www.bluetooth.com).

Figure 2:
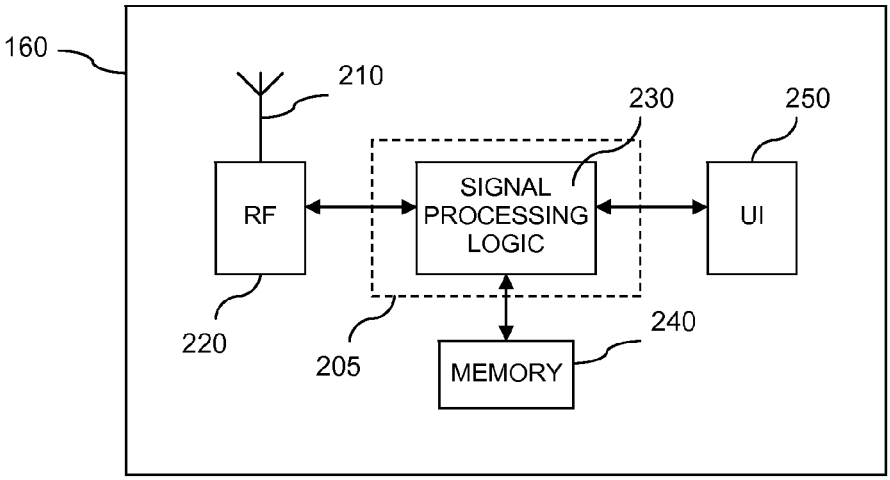
FIG. 2 illustrates an example of a simplified block diagram of a radio frequency controller device.

Referring now to FIG. 2, there is illustrated an example of a simplified block diagram of the RF remote controller device 160 of FIG. 1. Because the various components of the RF remote controller device 160 required for explaining and implementing the present invention are, for the most part, composed of electronic components and circuits known to those skilled in the art, circuit details will not be explained in any greater extent than that considered necessary for the understanding and appreciation of the underlying concepts of the invention and in order not to obfuscate or distract from the teachings of the present invention. Furthermore, and as will be appreciated by those skilled in the art, various components and elements of the RF remote controller device 160 have been omitted from FIG. 2 in order also not to obfuscate or distract from the teachings of the present invention.

For the illustrated example, the RF remote controller device 160 comprises RF circuitry 220 operably coupled to an antenna arrangement 210 and arranged to transmit and receive RF signals to and from controllable devices, such as the controllable devices 110, 120, 130, 140, 150 illustrated in FIG. 1. The RF remote controller device 160 further comprises an integrated circuit 205, for example in a form of a semiconductor device, comprising signal processing logic 230 arranged to be operably coupled to the RF circuitry 220, and to a user interface (UI) 250. The signal processing logic 230 may be arranged to transmit command signals to one or more of the controllable devices 110, 120, 130, 140, 150 in response to inputs received via the user interface 250. In this manner, a user of the RF remote controller device 160 is able to control a controllable device 110, 120, 130, 140, 150 by way of the user interface 250 of the RF remote controller device 160. The signal processing logic 230 may additionally or alternatively be arranged to transmit command signals to one or more of the controllable device 110, 120, 130, 140, 150 substantially autonomously, for example periodically or in response to some event, such as detection of movement of the RF remote controller device 160 or the like.

Typically, at any given moment, only one controllable device of any given type may be selected and controlled by an input means of a user interface of the RF remote controller device 150, for example by way of pressing one or more appropriate buttons or keys. For known RF remote controller devices, in order to select a different device of a certain type to that currently selected, a user of the RF remote controller device is required to manually select the device that they wish to control via a user interface of the RF remote controller device. As previously mentioned, such a need for a user to manually select the required device to be controlled can significantly degrade the user experience.

For the illustrated example, the antenna arrangement 210 is arranged to comprise a directivity characteristic in at least a first plane, and at least with respect to received RF signals. For example, such a directivity characteristic of the antenna, such as an antenna array, arrangement 210 may be provided as a result of structural dimensions of an antenna relative to the transmitted/received signal wave-length and a feed point of the antenna. For example, for a particular antenna design, changing the feed point typically affects the directivity characteristic. Injecting an additional current into the antenna, and/or providing grounding planes near the antenna are alternative techniques that may be used to provide a directivity characteristic to the antenna. A simpler, albeit less cost effective, means for providing the antenna arrangement 210 with a directivity characteristic may comprise using two different antennas.

In one example, the signal processing logic 230 is arranged, upon receipt of a command input from the user interface 250 relating to at least one type of controllable device, to determine at least one link quality values for controllable devices of the at least one type to which the received command input relates, select a controllable device of the at least one type to which the received command input relates comprising a most favourable link quality value, and transmit a control signal to the selected controllable device in accordance with the received command input. The at least one link quality value for controllable devices may be based at least partly on received RF signals for those controllable devices. For example, a link quality value for a controllable device may be determined based upon an expression of the quality of received data from the respective controllable device. In particular, the link quality value may be derived from, say, a received RF signal power level for the respective device, whereby a more favourable link quality may comprise a higher value. Alternatively such a link quality value may be derived from a bit error rate or similar error indicator, whereby a more favourable link quality may comprise a lower value. One example of a potentially suitable link quality value is a link quality indicator (LQI), which is typically directly influenced by the signal power at the receiver antenna and the interference present on the channel, and which is typically reported with each received data packet. However, in other examples, the link quality value for a device may be derived from alternative measurements or parameters etc.

In this manner, the signal processing logic 230 is able to automatically select a particular controllable device of the type to which the received command input relates having the most favourable link quality value. The antenna arrangement 210 comprises a directivity characteristic, and as a result, the link quality values for controllable devices may be significantly affected by the relative orientation of the RF remote controller device 160. In particular, a user of the RF remote controller device 160 may be able to influence which controllable device(s) has/have more favourable link quality values, for example simply by changing an orientation of the RF remote controller device 160. Thus, a user of the RF remote controller device 160 may influence the selection of a particular controllable device of the type to which a command input by the user relates simply by appropriately orientating the RF remote controller device 160.

For example, users of remote control devices are familiar with remote control devices that require a line of sight with their respective controllable devices, such as remote control devices that use infrared signals. Accordingly, users of such remote control devices intuitively orientate the remote control by 'pointing' an end of the remote control comprising the infrared transmitter towards the respective controllable device. Accordingly, the antenna arrangement 210 of the RF remote controller device 160 may be arranged such that a user of the RF remote controller device 160 may be able to improve the link quality value for a controllable device by generally pointing an end of the RF remote controller device 160 towards that controllable device, for example in a similar manner to a traditional line-of-site remote controller.

Figure 3:
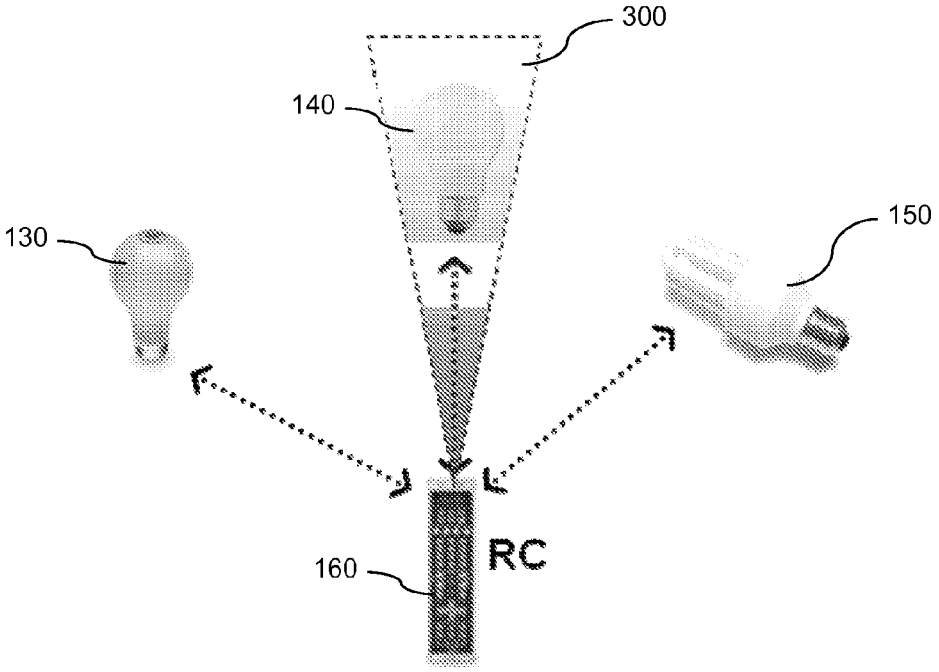
FIGS. 3 and 4 illustrate an example of a directivity characteristic for a radio frequency controller device.

In this manner, the user of the RF controller device 160 may cause the signal processing logic 230 to automatically select a specific controllable device by simply pointing the RF remote controller device 160 towards that device and inputting a command corresponding to that type of device via the user interface 250. For example, and as illustrated in FIG. 3, the antenna arrangement of the RF remote controller device 160 may be arranged such that its directivity characteristic results in a high gain region 300 within which the antenna arrangement may be more sensitive to received RF signals of the appropriate frequency. As a result, RF signals received from within this high gain region 300, such as signals received from lighting system 140 for the illustrated example, will likely have superior link quality values than signals received from outside this region, such as RF signals received from lighting system 130 or lighting system 150 for the illustrated example. Thus, by orienting the RF remote controller device 160 as illustrated in the example of FIG. 3, the link quality value for lighting system 140, as perceived by the RF remote controller device 160, will be superior compared to those of lighting systems 130 and 150. Accordingly, the signal processing logic of RF remote controller device 160 will automatically select lighting system 140 as the lighting system device to which to send corresponding commands based on the orientation of the RF remote controller device 160. As a result, the need for the user to manually select a required device to be controlled may be substantially alleviated, thereby improving the user experience.

Figure 4:
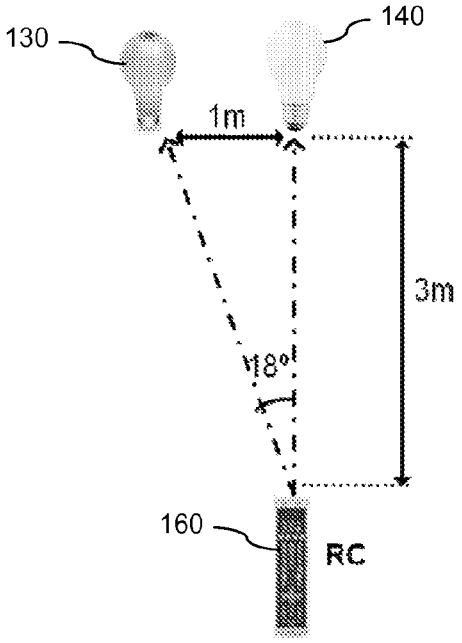

Referring now to FIG. 4, in another example the RF remote controller device 160 may be capable of discerning between two controllable devices, such as lighting systems 130 and 140 in the illustrated example, located, say, approximately three meters away from the RF remote controller device 160, and approximately one meter from one another. Thus, results in an angle of approximately 18 degrees of separation, as illustrated. Tests have shown that a difference of at least 3 dB between received signals is typically required to be able to consistently differentiate between different devices using their received link quality value(s) (for example is a case of a link quality indicator (LQI), a 3 dB difference in the received power typically translates into a 13 unit difference on the reported LQI). Accordingly, the directive characteristic of the antenna arrangement is required to have at least a −3 dBi gain over 18 degrees, which is easily within the capabilities of known directive antenna arrangements.

In accordance with some examples, the antenna arrangement (210) may be selectably arranged, at least with respect to received RF signals, to comprise a directivity characteristic in at least a first plane, where the directivity characterised is a substantially omni-directional characteristic. Accordingly, the signal processing logic 230 may be arranged, upon receipt of a command input from the user interface 250 and relating to at least one type of controllable device, to cause the directivity characteristic of the antenna arrangement 210 to be selected, and to determine at least one link quality value for at least one controllable device based on an RF signal received from the at least one controllable device via the antenna arrangement 210 with the directivity characteristic of the antenna arrangement 210 selected. For example, the signal processing logic 230 may cause the directivity characteristic of the antenna arrangement 210 to be selected by enabling an injection of an additional current into a feed point of the antenna arrangement 210. In contrast, at other times, the signal processing logic 230 may be able to cause the omni-directional characteristic of the antenna arrangement 210 to be selected, such that RF signals may be received with substantially equal efficiency from all directions.

The signal processing logic 230 may be arranged to determine at least one link quality value for a plurality of controllable devices by transmitting a discovery request, for example in a form of a data packet, and determining the at least one link quality value for a number of controllable devices based at least partly on received responses, for example also in a form of a data packet, to the discovery request. The discovery request may comprise information identifying the type of controllable device(s) to which a received command input from the user interface 250 relates, and from which responses to the request are required. In this manner, only controllable devices of the relevant type will respond to the discovery request, thereby reducing a number of responses that the signal processing logic 230 may be required to process, and thereby reducing the response time and power consumption of the RF remote controller device 160. Furthermore, the discovery request may be transmitted on a broadcast address so that the discovery request may be received by substantially all controllable devices. However, in one example, only those controllable devices that have paired with, or are otherwise associated with, the RF remote controller device transmitting the discovery request may be arranged to accept and process the request, and subsequently respond. As a result, responses may only be received from controllable devices with which the RF remote controller device is paired. In this manner, the RF remote controller device 160 may not receive unnecessary responses from controllable devices with which it is not paired.

The antenna arrangement 210 may also be arranged to comprise a directivity characteristic in at least a first plane with respect to transmitted RF signals. Such a directivity characteristic for a transmission of RF signals may result in one or more controllable devices that are not within the high gain region receiving the discovery request with a lower signal power, or not receiving the discovery request at all. Since receivers within controllable devices need a minimum signal power to be able to receive and decode a data packet within the transmission and pass the packet for processing to high layers, controllable devices that are not within the high gain region may not receive the signal with sufficient signal power. As a result, fewer devices will typically respond to discovery requests transmitted using the directivity characteristic of the antenna arrangement 210, thereby reducing a number of responses that the signal processing logic 230 may be required to process, and thereby further reducing the response time and power consumption of the RF remote controller device 160. The directivity characteristic of the antenna arrangement 210 with respect to transmitted RF signals may also be selectable by the signal processing logic 230.

Directional RF scanning in order to perform controllable device selection by the signal processing logic 230 as hereinbefore described, may be performed substantially automatically for all device types. In this manner, whenever a user inputs a command via the user interface 250, the signal processing logic 230 may be arranged to automatically implement device selection functionality, such as that described above, irrespective of the type of device(s) to which the command relates.

However, an alternative example, the signal processing logic 230 may be arranged to only implement device selection functionality for certain predefined types of controllable device. For example, upon receipt of a command input from the user interface 250, the signal processing logic 230 may be arranged to determine whether the at least one type of controllable device to which the received command input relates corresponds to a predetermined type of controllable device for which directivity is required. For example, a list of device types for which directivity is, or is not, required may be stored within a memory element 240 of the RF remote controller device 160, and upon receipt of a command input from the user interface 250, the signal processing logic 230 may identify the type(s) of device to which the command relates, and to compare the identified device type(s) to the list of device types stored in memory 240.

If at least one type of controllable device to which the received command input relates corresponds to a predetermined type of controllable device for which directivity is required, the signal processing logic 230 may then be arranged to select a controllable device of the at least one type to which the received command input relates comprising a most favourable at least one link quality value, and to transmit a control signal to the selected controllable device in accordance with the received command input as described above. If appropriate, the signal processing logic 230 may also be arranged to firstly cause the directivity characteristic for the antenna arrangement 210 to be selected.

Conversely, if the at least one type of controllable device to which the received command input relates does not correspond to a predetermined type of controllable device for which directivity is required, the signal processing logic 230 may be arranged to transmit a control signal to a currently selected controllable device of the at least one type to which the received command input relates. If appropriate, the signal processing logic 230 may also be arranged to firstly cause, say, the omni-directional characteristic of the antenna arrangement 210 to be selected.

In accordance with an alternative example, the device selection functionality may be capable of being enabled and disabled by a user of the RF remote controller device 160, for example by way of the user interface 250. Accordingly, upon receipt of a device control command input from the user interface 250, the signal processing logic 230 may be arranged to determine whether automatic device selection functionality has been enabled. For example, an integer value stored within the memory element 240 may indicate whether the automatic device selection functionality has been enabled or disabled, and the signal processing logic 230 may retrieve said integer value to determine whether the automatic device selection functionality has been enabled.

If the automatic device selection functionality has been enabled, the signal processing logic 230 may then be arranged to select a controllable device of the type to which the received command input relates comprising a most favourable at least one link quality value, and to transmit a control signal to the selected controllable device in accordance with the received command input. Conversely, if automatic device selection functionality has not been enabled, the signal processing logic 230 may then be arranged to transmit a control signal to a currently selected controllable device of the type to which the received command input relates.

Where the automatic device selection functionality is capable of being enabled by a user of the RF remote controller device 160, the automatic device functionality may be enabled for all further commands until the automatic device selection functionality is disabled. Alternatively, the automatic device functionality may be enabled only for the next command or set of commands.

Figure 5:
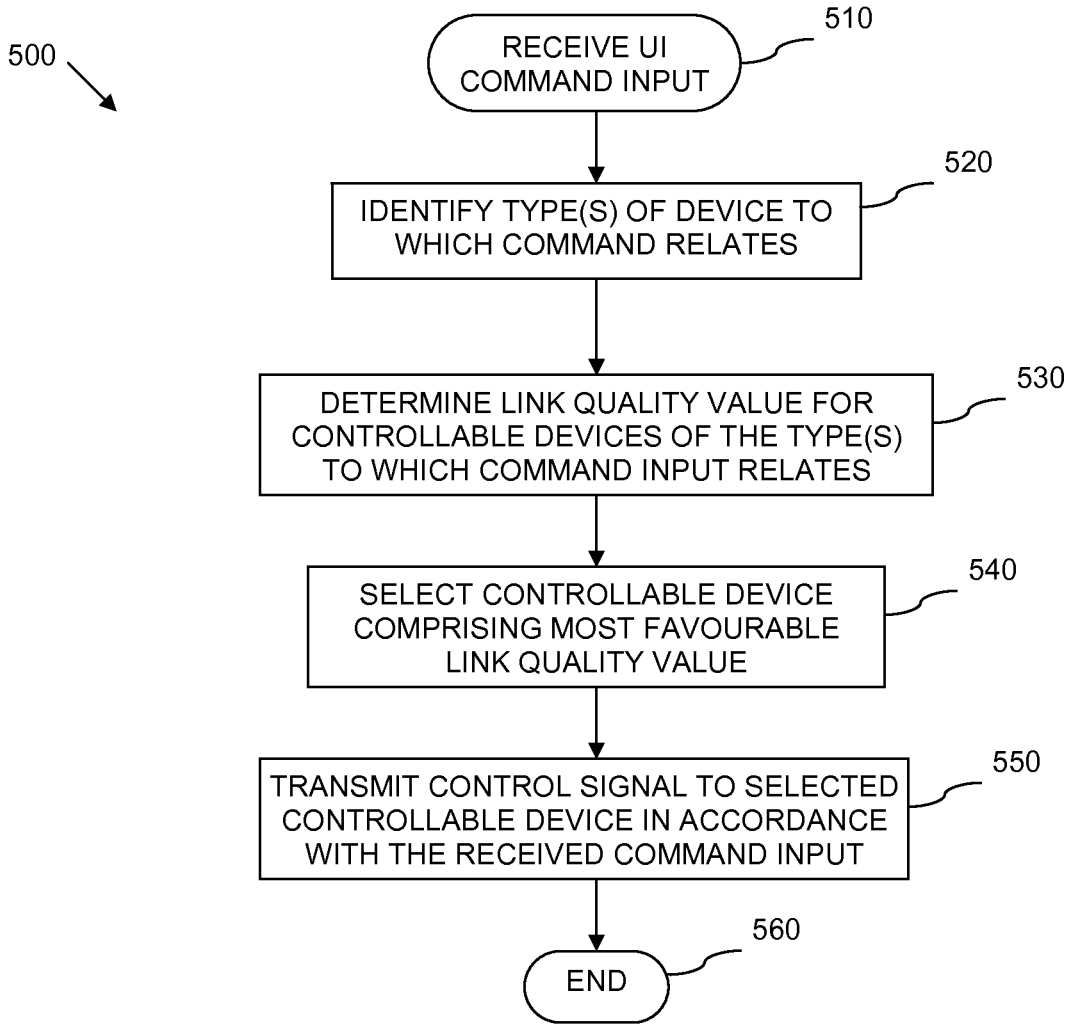
FIG. 5 illustrates an example of a simplified flowchart of a method for selecting at least one controllable device.

Referring now to FIG. 5, there is illustrated an example of a simplified flowchart 500 of a method for selecting at least one controllable device to be controlled by a radio frequency (RF) controller device. For example, the signal processing logic 230 of FIG. 2 may be arranged to implement the method of FIG. 5, such as by way of executing computer-readable code stored in memory 240 of FIG. 2.

The method starts at step 510 with a receipt of a command input by way of, say, a user interface of the RF remote controller device. Next, in step 520, for the illustrated example, the type of device(s) to which the received command relates is/are identified. The received command may relate to a single type of device, or may relate to more than one type of device. For example, a volume command may relate to audio-visual devices, such as television sets as well as purely audio devices such as music systems and the like.

The method then moves on to step 530, where at least one link quality value for a number of controllable devices of the type(s) to which the received command input relates is determined, based at least partly on received RF signals for said controllable device(s). As previously mentioned, the at least one link quality value for the number of controllable devices may be based at least partly on received RF signals for those controllable devices. For example, a link quality value for a controllable device may be determined based upon an expression of the quality of received data from the respective controllable device. In particular, the link quality value may be derived from, say, a received RF signal power level for the respective device, whereby a more favourable link quality may comprise a higher value. Alternatively such a link quality value may be derived from a bit error rate or similar error indicator, whereby a more favourable link quality may comprise a lower value. One example of a potentially suitable link quality value is a link quality indicator (LQI), which may be typically directly influenced by the signal power at the receiver antenna and the interference present on the channel, and which is typically reported with each received data packet. However, the link quality value for a device may be derived from alternative measurements or parameters etc.

Next, in step 540, a controllable device of the at least one type to which the received command input relates, comprising a most favourable link quality value is selected. A control signal may then be transmitted to the selected controllable device in accordance with the received command input, in step 550. The method then ends at step 560.

The invention may also be implemented in a computer program for running on a programmable apparatus, at least including code portions for performing steps of a method according to the invention when run on a programmable apparatus, such as a computer system or enabling a programmable apparatus to perform functions of a device or system according to the invention. The term "program," as used herein, is defined as a sequence of instructions designed for execution on a computer system. The computer program may for instance include one or more of: a subroutine, a function, a procedure, an object method, an object implementation, an executable application, an applet, a servlet, a source code, an object code, a shared library/dynamic load library and/or other sequence of instructions designed for execution on a computer system. A program is typically stored internally on computer readable storage medium or transmitted to the computer system via a computer readable transmission medium. The computer program may be provided on a data carrier, such as a CD-rom or diskette, stored with data loadable in a memory of a computer system, the data representing the computer program. The data carrier may further be a data connection, such as a telephone cable or a wireless connection.

In the foregoing specification, the invention has been described with reference to specific examples of embodiments of the invention. It will, however, be evident that various modifications and changes may be made therein without departing from the broader spirit and scope of the invention as set forth in the appended claims. For example, the connections may be any type of connection suitable to transfer signals from or to the respective nodes, units or devices, for example via intermediate devices. Accordingly, unless implied or stated otherwise the connections may for example be direct connections or indirect connections.

As previously mentioned, because the apparatus implementing the present invention is, for the most part, composed of electronic components and circuits known to those skilled in the art, circuit details will not be explained in any greater extent than that considered necessary as illustrated above, for the understanding and appreciation of the underlying concepts of the present invention and in order not to obfuscate or distract from the teachings of the present invention.

Some of the above examples, as applicable, may be implemented using a variety of different information processing systems. For example, although FIG. 2 and the discussion thereof describe an exemplary block diagram of an RF remote controller device, this exemplary architecture is presented merely to provide a useful reference in discussing various aspects of the invention. Of course, the description of the architecture has been simplified for purposes of discussion, and it is just one of many different types of appropriate architectures that may be used in accordance with the invention. Those skilled in the art will recognize that the boundaries between logic blocks are merely illustrative and that alternative examples may merge logic blocks or circuit elements or impose an alternate decomposition of functionality upon various logic blocks or circuit elements.

Thus, it is to be understood that the architectures depicted herein are merely exemplary, and that in fact many other architectures can be implemented which achieve the same functionality. In an abstract, but still definite sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermediary components. Likewise, any two components so associated can also be viewed as being "operably connected," or "operably coupled," to each other to achieve the desired functionality.

Also for example, in one example, the illustrated elements of signal processing logic 230 of FIG. 2 are located on a single integrated circuit or within a same device. Alternatively, signal processing logic 230 may include any number of separate integrated circuits or separate devices interconnected with each other. Furthermore, memory 240 of FIG. 2 may be located on a same integrated circuit as signal processing logic 230, or located within another peripheral device discretely separate from other elements of the RF remote controller device.

Furthermore, those skilled in the art will recognize that boundaries between the functionality of the above described operations are merely illustrative. The functionality of multiple operations may be combined into a single operation, and/or the functionality of a single operation may be distributed in additional operations. Moreover, alternative examples may include multiple instances of a particular operation, and the order of operations may be altered in various other examples. Furthermore, the devices may be physically distributed over a number of apparatuses, while functionally operating as a single device. Also, devices functionally forming separate devices may be integrated in a single physical device. However, other modifications, variations and alternatives are also possible. The specifications and drawings are, accordingly, to be regarded in an illustrative rather than in a restrictive sense.

In the claims, any reference signs placed between parentheses shall not be construed as limiting the claim. The word 'comprising' does not exclude the presence of other elements or steps then those listed in a claim. Furthermore, Furthermore, the terms "a" or "an," as used herein, are defined as one or more than one. Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles. Unless stated otherwise, terms such as "first" and "second" are used to arbitrarily distinguish between the elements such terms describe. Thus, these terms are not necessarily intended to indicate temporal or other prioritization of such elements. The mere fact that certain measures are recited in mutually different claims does not indicate that a combination of these measures cannot be used to advantage.

The invention claimed is:

1. A radio frequency (RF) remote controller device comprising:

radio frequency (RF) circuitry operably coupled to an antenna arrangement and arranged to transmit and receive RF signals to and from a plurality of controllable devices;

a memory element for storing a list of device types for which directivity is, or is not, required; and signal processing logic operably coupled to the RF circuitry and to a user interface;

wherein:

the antenna arrangement is arranged to comprise a directivity characteristic; and the signal processing logic upon receipt of a command input from the user interface, is arranged to:

determine at least one link quality value that is at least partly dependent upon the directivity characteristic for at least one controllable device of the plurality of controllable devices; and select the at least one controllable device for remote controlling based on the determined at least one link quality value and a determination that the at least one controllable device is of a type of certain predefined types according to the list of device types.

2. The RF remote controller device of claim 1 wherein the antenna arrangement is selectably arranged to employ the directivity characteristic and an omni-directional characteristic in at least a first plane based upon a received RF signal of the RF signals.

3. The RF remote controller device of claim 1 wherein the signal processing logic is arranged, upon receipt of a command input from the user interface relating to at least one type of controllable device, to cause the directivity characteristic of the antenna arrangement to be selected, and to determine link quality values for at least a portion of the plurality of controllable devices based on RF signals received from the at least the portion of the plurality of controllable devices via the antenna arrangement with the directivity characteristic of the antenna arrangement selected.

4. The RF remote controller device of claim 1 wherein the signal processing logic is arranged to determine the at least one link quality value for at least one controllable device by:

transmitting a discovery request to the plurality of controllable devices; and determining a plurality of link quality values for the plurality of controllable devices based at least partly on a plurality of received RF responses to the discovery request.

5. The RF remote controller device of claim 4 wherein the discovery request for the plurality of controllable devices comprises information identifying at least one type of controllable device to which the received command input from the user interface relates.

6. The RF remote controller device of claim 1 wherein the signal processing logic is arranged to transmit a control signal to the selected controllable device based on the received command input.

7. The RF remote controller device of claim 1 wherein the antenna arrangement is further arranged to comprise at least one directivity characteristic in at least a first plane with respect to at least one transmit RF signal.

8. The RF remote controller device of claim 1 wherein the directivity characteristic of the antenna arrangement is provided as a result of a structural dimension of an antenna relative to a transmit or received RF signal wave-length and a feed point of the antenna.

9. The RF remote controller device of claim 1 wherein the directivity characteristic of the antenna arrangement is provided by two different antennas.

10. The RF remote controller device of claim 1 wherein, upon receipt of a user command input from the user interface, the signal processing logic is arranged to determine whether automatic device selection has been enabled, and if automatic device selection has been enabled, the signal processing logic is arranged to select an automatically selectable controllable device of at least one type to which the received user command input relates based upon the at least one link quality value, and to transmit a control signal to the selected automatically selectable controllable device.

11. The radio frequency remote controller device of claim 1, wherein the radio frequency remote controller device is included in a radio frequency (RF) remote control system.

12. The radio frequency (RF) remote controller device of claim 1 wherein the selecting the at least one controllable device applies only for a next command input or next set of command inputs.

13. The radio frequency (RF) remote controller device of claim 1 wherein the selecting is further based on receiving a response to the discovery request, wherein the response to the discovery request is received from the at least one controllable device when the at least one controllable device is paired with, or otherwise associated with, the RF remote controller device.

14. The radio frequency (RF) remote controller device of claim 1 wherein the selecting the at least one controllable device is enabled for further command inputs until subsequently being disabled.

15. An integrated circuit for a radio frequency (RF) remote controller device comprising signal processing logic configured to coupling to radio frequency (RF) circuitry and an antenna arrangement arranged to transmit and receive RF signals to and from a plurality of controllable devices, wherein, upon receipt of a command input, the signal processing logic is arranged to:

determine at least one link quality value for at least one controllable device of the plurality of controllable devices that is at least partly dependent upon a directivity characteristic of the antenna arrangement; and select the at least one controllable device for remote controlling based on the determined at least one link quality value, wherein the selecting the at least one controllable device applies only for a next command input or next set of command inputs, wherein the selecting is further based on a determination that the at least one controllable device is of a type of certain predefined types stored in a memory element list of device types for which directivity is, or is not, required.

16. The integrated circuit of claim 15 wherein the selecting is further based on receiving a response to the discovery request, wherein the response to the discovery request is received from the at least one controllable device when the at least one controllable device is paired with, or otherwise associated with, the RF remote controller device.

17. A method for selecting at least one device to be controlled by a radio frequency (RF) remote controller device, the method comprising:

transmitting a discovery request;

receiving a command input from a user interface of the RF remote controller device;

determining at least one link quality value for at least one controllable device that is at least partly dependent upon a directivity characteristic of an antenna arrangement, the antenna arrangement coupled to the RF remote controller device; and selecting the controllable device for remote controlling based on the determined at least one link quality value and on receiving a response to the discovery request, wherein the response to the discovery request is received from the at least one controllable device only if the at least one controllable device has paired with the RF remote controller device, wherein the selecting is further based on a determination that the at least one controllable device is of a type of certain predefined types stored in a memory element of the RF remote controller device as a list of device types for which directivity is, or is not, required.

18. The method of claim 17 wherein the selecting the at least one controllable device applies only for a next command input or next set of command inputs.

* * * * *